United States Patent [19]

Bell

[11] 4,339,216

[45] Jul. 13, 1982

[54] EQUIPMENT FOR LAYING A LAYER OF ELONGATE MATERIAL ADJACENT TO AN EXPOSED ROCK OR MINERAL SURFACE IN AN UNDERGROUND MINE

[75] Inventor: Roy L. Bell, Burton-on-Trent, England

[73] Assignee: Coal Industry (Patents) Limited, London, England

[21] Appl. No.: 133,044

[22] Filed: Mar. 24, 1980

[30] Foreign Application Priority Data

May 23, 1979 [GB] United Kingdom ..... 7917967

[51] Int. Cl.[3] ..... E21D 19/02

[52] U.S. Cl. ..... 405/303; 299/33; 405/288

[58] Field of Search ..... 405/150, 288, 296, 303; 299/11, 33

[56] References Cited

U.S. PATENT DOCUMENTS 3,399,927 9/1968 Groetschel ..... 299/11
4,099,785 7/1978 Groetschel ..... 299/11
4,122,682 10/1978 Groetschel ..... 405/150
4,190,292 2/1980 Johannes et al. ..... 405/296 X
4,229,043 10/1980 Bell et al. ..... 299/11 X

FOREIGN PATENT DOCUMENTS 1350988 4/1974 United Kingdom .
1383430 2/1975 United Kingdom .
2018862 10/1979 United Kingdom .

*Primary Examiner*—David H. Corbin
*Attorney, Agent, or Firm*—James C. Wray

[57] ABSTRACT

Equipment for laying a layer of elongate material adjacent to an exposed rock or mineral surface in an underground mine comprises a support bracket for attachment to a mining machine body, support arms means pivotally supported by the support bracket at one end and having support means for a store of elongate material at its other end, in use, the support means being urged towards the exposed rock or mineral surface by resilient means co-operating with an over-center device mounted on the support bracket.

18 Claims, 2 Drawing Figures

Figure 1:
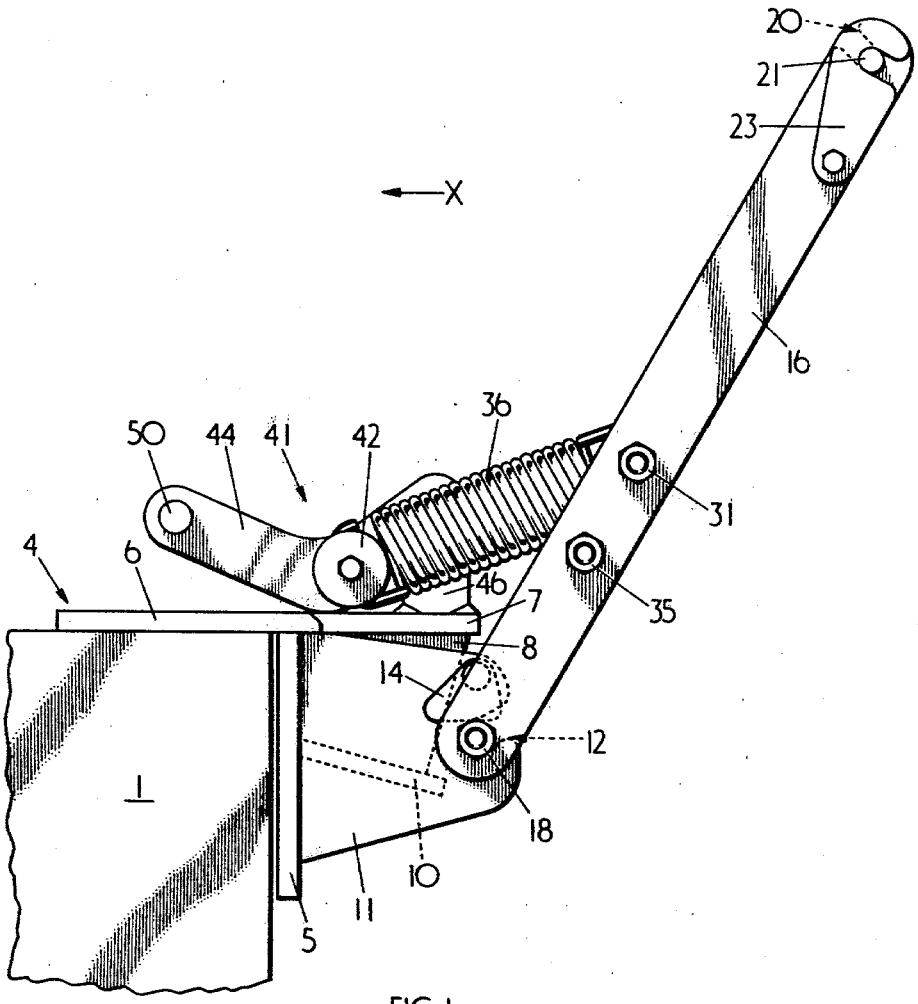

EQUIPMENT FOR LAYING A LAYER OF ELONGATE MATERIAL ADJACENT TO AN EXPOSED ROCK OR MINERAL SURFACE IN AN UNDERGROUND MINE

This invention relates to equipment for laying a layer of elongate material, for example, wire mesh or wire mesh with a sheet backing adjacent to an exposed rock or mineral surface in an underground mine.

In particular, the present invention relates to such equipment securable to a mining machine including a cutter for cutting rock or mineral from a working face, the equipment laying the layer of elongate material adjacent to the rock or mineral surface newly exposed by the cutter as it traverses along the working face.

Previously, it has been proposed to mount equipment for laying a layer of wire mesh adjacent to an exposed mine roof on the body of the mining machine, the equipment being cantilevered from the body of the machine into the formed track left directly behind the cutter. The equipment comprised storage means for a coil of elongate material which, in use, as the machine traverses along the working face is uncoiled, and guide roller means for guiding the material unwinding from the coil into contact with the mine roof. Unfortunately, such prior known equipment tended to be complicated to operate and liable to be easily damaged. Consequently, it never found wide favour and was never widely exploited.

An object of the present invention is to provide equipment for laying a layer of elongate material adjacent to an exposed mine roof which tends to be simple and robust and which tends to overcome or reduce the above mentioned disadvantage.

According to the present invention, equipment for laying a layer of elongate material adjacent to a newly exposed rock or mineral surface formed by a mining machine cutter as the machine traverses along a working face, comprises a support bracket for fixed attachment to the mining machine, support arm means for supporting a store of elongate material, the support arm means extending from the support bracket and being pivotally supported by the support bracket, resilient means for moving the support arm means about its pivotal mounting, and an over centre device which in one operational mode is adapted to co-operate with the resilient means to urge the support arm means about its pivotal mounting to urge support means for the store of elongate material towards the newly exposed rock or mineral surface and which in a further operational mode is adapted to co-operate with the resilient means to permit the support arm means to move about its pivotal mounting to allow the support means for the store of elongate material to move to a position clear of the newly exposed rock or mineral surface.

Preferably, the resilient means comprises at least one coil spring attached at one end to the support arm means and at the other end to the over centre device.

Advantageously, the support arm means can be disconnected from the support bracket.

Advantageously, the support arm means comprises two parallel arms interconnected by a cross-rod.

Conveniently, the cross-rod is pivotally engageable in slot means provided on the support bracket.

Advantageously, the slot means comprises catch means for releasably retaining the cross-rod in pivotal engagement with the slot means.

Preferably, the support arm means rotatably support an axle constituting at least a part of the support means which in use, supports the store of elongate material.

Conveniently, the axle rotatably engages in further slot means provided on the support arm means.

Preferably, the further slot means comprise further catch means for rotatably retaining the axle in engagement with the further slot means.

The present invention also provides a mining machine comprising equipment for laying a layer of elongate material adjacent to a newly exposed rock or mineral surface formed by a cutter which in use is mounted on the machine, the equipment being as defined above.

Figure 2:
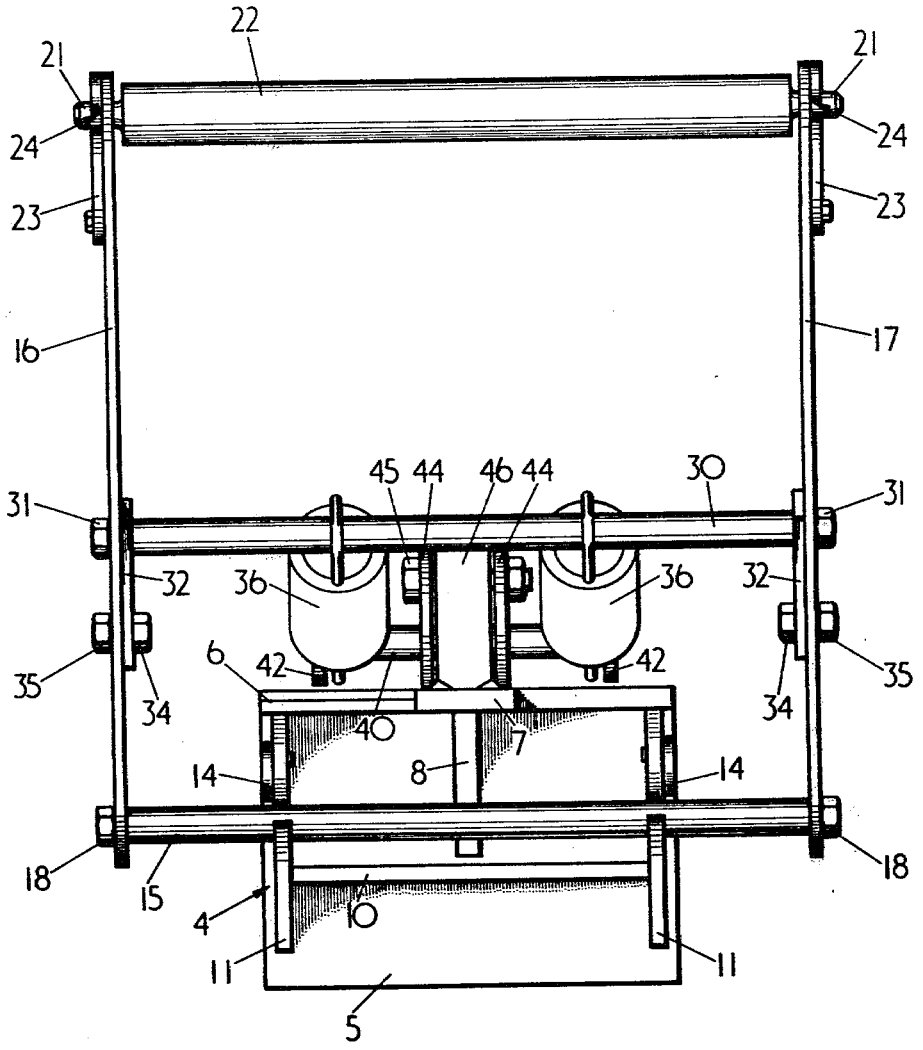

By way of example only, one embodiment of the present invention will be described with reference to the accompanying drawings, in which:

FIG. 1 is a side view of equipment constructed in accordance with the present invention; and FIG. 2 is a rear view of the equipment of FIG. 1.

The drawings show equipment for laying a layer of elongate material, for example, wire mesh or wire mesh with a sheet backing adjacent to an exposed rock or mineral mine roof surface (not shown) in an underground mine. The equipment is attached to a shearer mineral winning machine 1 (only a part of the body of which is shown in FIG. 1) which has a rotary cutter (not shown) arranged to cut rock or mineral from a working face as the machine traverses along the working face in a direction indicated by arrow X in FIG. 1. The cut rock or mineral is urged by the rotating cutter towards a conveyor (not shown) extending along the working face. As the machine traverses along the face the equipment lays a layer of wire mesh adjacent to the mine roof, the wire mesh being retained adjacent to the mine roof by roof supports which are advanced and set to the mine roof immediately following the passage of the machine.

The equipment for laying the layer of wire mesh comprises a support bracket 4 including a generally 'L' shaped plate formation (as seen in FIG. 1) having a downwardly extending limb 5 and a horizontally extending limb 6 secured to the machine body 1 by bolts (not shown).

The horizontally extending plate 6 has a rearwardly extending projection 7 secured to the downwardly extending limb 5 by a strengthening lug 8 which has at its lowermost end a cross-plate 10 secured between two rearwardly extending support plates 11 projecting from the downwardly extending limb 5.

The support plates 11 are provided with slot means comprising downwardly inclined slots 12 and pivotal catch means 14 for releasably and pivotally retaining a cross-rod 15 within the slots.

The slots 12 and cross-rod 15 constitute pivotal mounting means for support arm means comprising two parallel arms 16 and 17 rigidly secured to the ends of the cross-rod by nuts 18. The upper end of each arm is provided with support means comprising further slot means providing a upwardly directed slot 20 for engagement by an axle 21 of a roller 22 upon which, in use, a store or roll (not shown) of elongate material is mounted. The further slot means also comprises a pivotally mounted catch 23 having a downward directed slot 24 for engagement with the axle 21 to retain the axle in the associated slot 20.

The two support arms 16 and 17 are further connected to each other by a second cross-rod 30, the ends of which are retained in engagement with the associated arm by a nut 31. A strengthening lug 32 is fixedly secured to the associated end of the cross-rod 30 and to the associated arm by a nut and bolt attachment 34, 35, ensuring that the support arm means is rigid.

Each of two coil springs 36 is attached at one end to the cross-rod 30 and at its other end to a cross-shaft 40 of an over centre device 41, the springs being retained on the shaft by end stops 42. The over centre device comprises a cranked lever assembly 44 including two parallel legs and having one limb pivotally mounted on a cross-pivot bolt 45 retained in a bore (not shown) provided by 1 pillar 46 upstanding from the rearwardly extending projection 7 of the horizontally extending plate 6. The other limb of the cranked lever assembly 44 is provided with a handle 50 enabling the over centre device to be pivoted about the bolt 45 from one operational mode in which the cranked lever assembly is positioned on the one side of pivot bolt 45 to a second operation mode in which the cranked lever assembly is positioned on the opposite side of the pivot bolt. In FIG. 1 the lever assembly is shown in its operational mode on the left hand side of the pivot bolt so as to tension the coil springs to urge the support arms upwards towards the mine roof. In FIG. 1 the action of the springs is to urge the lever assembly to pivot anticlockwise into abutment with the horizontally extending plate 6. Thus, the action of the springs in FIG. 1 is to retain the lever assembly in the operational mode indicated.

Upon an operator wishing to release the springs from urging the support arm means upwards towards the mine roof the handle 50 of the lever assembly 44 is pivoted clockwise as seen in FIG. 1 about the pivot bolt 45 until the shaft 40 passes a position in line with the cross-rod 30 and the pivot bolt 45. Further clockwise movement of the lever detensions the coil springs 36 and lowers the support arm means away from the mine roof.

In use, before the machine starts its traverse along the working face and with the over centre device in its operational mode associated with the support arm means being lowered from the mine roof, the storage means is loaded by pivoting the catch means 23 to expose the slots 20 and placing the axle 21 of the loaded roller 22 into the slots, the loaded roller being passed along the axis of a roll of elongate material (not shown). Once the axle is located in the slots it is retained in position by pivoting the catch means 23 so the downwardly directed slot 24 engages the axle.

The operator then pivots the lever assembly 44 anticlockwise as seen in FIG. 1 into its second operational mode tensioning the coil springs 36 to urge the support arm means together with roll of stored elongate material upwards towards the mine roof.

Thus, as the machine starts its cutting traverse along the working face with the rotary cutter winning mineral to expose the mine roof, elongate material, for example, wire mesh, is unwound from the roll and laid adjacent to the mine roof where it is supported by newly advanced mine roof supports and/or is attached along one edge to the next adjacent layer of material which was laid on an earlier traverse of the machine along the face.

When the machine reaches the end of the working face the elongate material is cut and the remaining roll of elongate material is lowered from the mine roof by pivoting the cranked lever 44 of the over centre device 41 clockwise as seen in FIG. 1 until the over centre position is reached. Further clockwise movement of the lever 44 detensions the coil springs 36 and lowers the support arm means moving the roll away from the mine roof.

Once in the lowered position, the roll is removed and the catch means 14 moved from a position in which they retain the cross-rod 15 within the slots 12 into a position in which they permit the cross-rod 15 to be removed from the slots and the whole of the support arm means to be laid on top of the machine body. The machine then is traversed along the longwall face in the opposite direction.

Once the machine reaches the end of the face, the cross-rod is re-engaged in the slots 12 and the catch means 14 pivoted to retain the cross-rod in the slots. The whole of the above outlined procedure is repeated, the roll of elongate material being reloaded on the roller 22 which is engaged in the slots 20 before the over centre device 41 is pivoted into its operational mode tensioning the coil springs 36 to urge the support arm means upwards and the roll of elongate material towards the mine roof. The machine then lays a further layer of elongate material adjacent to the mine roof.

From the above description it will be appreciated that the present invention provides simple convenient and robust equipment for laying a layer of elongate material along a newly exposed mine roof so that an effectively continuous curtain of, for example, wire mesh or wire mesh with a sheet backing is provided ajacent to the mine roof. Thus friable mine roof tends to be contained and broken rock or mineral tends to be prevented from falling into the travelling passage defined by the roof supports.

I claim:

1. Equipment for laying a layer of elongate material adjacent to a newly exposed rock or mineral surface formed by a mining machine cutter as the machine traverses along a working face, comprising a support bracket for fixed attachment to the mining machine, the support bracket having a first pivot, support arm means for supporting a store of elongate material, the support arm means extending from the first pivot on the support bracket and being pivotally supported by the first pivot on the support bracket, resilient means for moving the support arm means about its pivotal mounting, and an over center device which has a second fixed pivot parallel to the first pivot and having a lever connected to the second pivot, the resilient means being connected to the lever and to the support arm, whereby the lever in one operational mode is adapted to cooperate with the resilient means to urge the support arm means about its pivotal mounting to urge support means for the store of elongate material towards the newly exposed rock or mineral surface and which in a further operational mode is adapted to cooperate with the resilient means to permit the support arm means to move about its pivotal mounting to allow the support means for the store of elongate material to move to a position clear of the newly exposed rock or mineral surface.

2. Equipment as claimed in claim 1, in which the resilient means comprises at least one coil spring attached at one end to the support arm means and at the other end to the lever of the over centre device.

3. Equipment as claimed in claim 2, in which the support arm means can be disconnected from the support bracket.

4. Equipment as claimed in claim 3, in which the support arm means comprises two parallel arms interconnected by a cross-rod.

5. Equipment as claimed in claim 4, in which the cross-rod is pivotally engageable in slot means provided on the support bracket.

6. Equipment as claimed in claim 5, in which the slot means comprises catch means for releasably retaining the cross-rod in pivotal engagement with the slot means.

7. Equipment as claimed in claim 6, in which the support arm means rotatably support an axle constituting at least a part of the support means which in use, carries the store of elongate material.

8. Equipment as claimed in claim 7 in which the axle rotatably engages in further slot means provided on the support arm means.

9. Equipment as claimed in claim 8, in which the further slot means comprise further catch means for rotatably retaining the axle in engagement with the further slot means.

10. A mining machine having a body, said machine adapted to excavate material from a rock or mineral surface as, in use, the machine traverses along a working face, the machine being provided with equipment for laying a layer of elongate material adjacent to a newly exposed rock or mineral surface formed by the machine, the equipment comprising a support bracket fixedly attached to the mining machine body, support arm means extending from the support bracket and being pivotally supported by the support bracket, support means for a store of elongate material supported by the support arm means, resilient means for moving the support arm means about its pivotal mounting, and an over centre device which in one operational mode co-operates with the resilient means to urge the support arm means about its pivotal mounting to urge the support means for the store of elongate material towards said newly exposed rock or mineral surface and which in a further operational mode co-operates with the resilient means to permit the support arm means to move about its pivotal mounting to allow the support means for the store of elongate material to move to a position clear of the newly exposed rock or mineral surface.

11. A mining machine as claimed in claim 10, in which the resilient means comprises at least one coil spring attached at one end to the support arm means and at the other end to the over centre device.

12. A mining machine as claimed in claim 11, in which the support arm means can be disconnected from the support bracket.

13. A mining machine as claimed in claim 12, in which the support arm means comprises two parallel arms interconnected by a cross-rod.

14. A mining machine as claimed in claim 13, in which the cross-rod is pivotally engageable in slot means provided on the support bracket.

15. A mining machine as claimed in claim 14, in which the slot means comprises catch means for releasably retaining the cross-rod in pivotal engagement with the slot means.

16. A mining machine as claimed in claim 15, in which the support arm means rotatably support an axle constituting at least a part of the support means which in use, carries the store of elongate material.

17. A mining machine as claimed in claim 16 in which the axle rotatably engages in further slot means provided on the support arm means.

18. A mining machine as claimed in claim 17, in which the further slot means comprise further catch means for rotatably retaining the axle in engagement with the further slot means.

* * * * *